US008863501B2

(12) United States Patent
Reusing et al.

(10) Patent No.: US 8,863,501 B2
(45) Date of Patent: Oct. 21, 2014

(54) INJECTION SYSTEM FOR INJECTING FLUID INTO AN EXHAUST TRACT

(75) Inventors: Volker Reusing, Stuttgart (DE); Chris Weirauch, Stuttgart (DE); Stefan Stein, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 253 days.

(21) Appl. No.: 13/380,238

(22) PCT Filed: Apr. 26, 2010

(86) PCT No.: PCT/EP2010/055491

§ 371 (c)(1),
(2), (4) Date: Jan. 23, 2012

(87) PCT Pub. No.: WO2010/149409

PCT Pub. Date: Dec. 29, 2010

(65) Prior Publication Data

US 2012/0131910 A1 May 31, 2012

(30) Foreign Application Priority Data

Jun. 25, 2009 (DE) ..... 10 2009 027 182

(51) Int. Cl.

| | |
|---|---|
| ***F01N 3/00*** | (2006.01) |
| ***F01N 13/00*** | (2010.01) |
| ***F01N 3/36*** | (2006.01) |
| ***F01N 3/025*** | (2006.01) |

(52) U.S. Cl.

CPC ..... *F01N 3/0253* (2013.01); *F01N 13/011* (2013.01); *F01N 2610/1446* (2013.01); *F01N 2610/14* (2013.01); *F01N 3/36* (2013.01); *F01N 2610/03* (2013.01)

USPC ..... 60/295; 60/286; 239/88; 138/26; 138/30; 138/31; 123/455; 123/465; 123/457; 123/460

(58) Field of Classification Search

USPC ..... 60/286, 295; 239/88; 123/455–457, 123/460; 138/26, 30, 31

See application file for complete search history.

(56) References Cited

U.S. PATENT DOCUMENTS

| | | | | |
|---|---|---|---|---|
| 6,125,629 | A | 10/2000 | Patchett | |
| 2004/0187848 | A1* | 9/2004 | Hlousek | 123/447 |
| 2005/0247048 | A1* | 11/2005 | Schaller et al. | 60/286 |
| 2007/0017216 | A1* | 1/2007 | Suzuki et al. | 60/286 |

(Continued)

FOREIGN PATENT DOCUMENTS

| | | |
|---|---|---|
| DE | 102006032155 | 1/2008 |
| JP | 2002081311 | 3/2002 |

(Continued)

OTHER PUBLICATIONS

PCT/EP2010/055491 International Search Report.

*Primary Examiner* — Jesse Bogue
*Assistant Examiner* — Philip Eklem
(74) *Attorney, Agent, or Firm* — Michael Best & Friedrich LLP

(57) ABSTRACT

The invention relates to an injection system for injecting a fluid into a filter provided in an exhaust system, comprising at least two modules and at least one pressure compensation volume (44, 46, 48, 54, 56, 58), which is designed for feeding fluid to at least one of the modules and hydraulically connects at least two of the modules. Each module comprises at least one injection unit (40, 50, 60) designed for injecting fluid into the exhaust system.

10 Claims, 6 Drawing Sheets

(56) References Cited

U.S. PATENT DOCUMENTS

| | | | | |
|---|---|---|---|---|
| 2008/0189025 | A1* | 8/2008 | Pauer | 701/103 |
| 2008/0202102 | A1 | 8/2008 | Rodriguez-Amaya et al. | |
| 2009/0050109 | A1 | 2/2009 | Hoffmann et al. | |
| 2009/0145400 | A1* | 6/2009 | Hanneke et al. | 123/446 |
| 2009/0223486 | A1 | 9/2009 | Weizenauer et al. | |
| 2009/0255234 | A1 | 10/2009 | Haeberer et al. | |
| 2010/0319325 | A1* | 12/2010 | Reusing et al. | 60/286 |

FOREIGN PATENT DOCUMENTS

| | | |
|---|---|---|
| JP | 2002221024 | 8/2002 |
| JP | 2002256850 | 9/2002 |
| JP | 2005307769 | 11/2005 |
| WO | WO 2008080693 A1 * | 7/2008 |

* cited by examiner

INJECTION SYSTEM FOR INJECTING FLUID INTO AN EXHAUST TRACT

BACKGROUND OF THE INVENTION

The invention relates to an injection system for injecting fluid into an exhaust tract.

Installing a particle filter in an exhaust system of an internal combustion engine of a vehicle is already known. If the internal combustion engine is a diesel engine, for example, the particle filter acts as a soot filter, for example, and through its filtering action reduces the fine dust pollution. In order to prevent the filter clogging after a certain period of service, it is necessary to regenerate the filter from time to time. The regeneration is performed by increasing the temperature to around 600 degrees Celsius, for example, resulting in combustion of the particles, in particular soot particles. Since engine measures will not allow this in all operating conditions, the increase in temperature is achieved by means of fuel, for example diesel fuel, which is injected into the exhaust tract via an injection valve. The injected fuel reaches an oxidation catalytic converter, which is arranged upstream of the particle filter. The fuel reaching the oxidation catalytic converter is oxidized or burned and leads to an increase in the temperature of the exhaust gas, so that correspondingly hot exhaust gases reach the downstream particle filter, where they bring about the regeneration.

Methods and devices for the regeneration of a particle filter are described, for example, in DE 10 2005 034 704 A1, DE 10 2006 062 491 A1 and DE 10 2006 057 425 A1.

The hitherto known systems for injecting fluid into an exhaust tract can be used only for a single exhaust tract and do not permit any increase in the quantity of fluid injected.

SUMMARY OF THE INVENTION

An object of the invention is to provide an improved system for injecting a fluid into an exhaust tract, which can easily be adapted to exhaust systems having multiple exhaust tracts and which allows fluid to be injected in any quantities.

An injection system according to the invention comprises at least two modules and at least one pressure compensation volume. The pressure compensation volume is designed for feeding fluid to at least one of the modules and connects at least two of the modules hydraulically to one another. Each of the modules has an inlet for receiving fluid and at least one injection unit, which is designed to inject fluid into the exhaust tract.

The modular construction makes the injection system according to the invention easy to adapt to multichannel exhaust systems and the different fluid injection quantities required. In particular, the insertion of additional modules makes it possible to inject fluid in any quantities.

The pressure compensation volume provided according to the invention damps the transmission of pressure oscillations between the individual modules. This ensures that substantially constant pressure conditions prevail on each module. This allows a precise injection of a predefined quantity of fluid.

In one embodiment at least the first module comprises a metering unit for metering the fluid. Such a metering unit allows the required injection quantity to be precisely fixed.

In a further embodiment the metering unit comprises a cutoff valve for cutting off the fluid feed and a metering valve for metering the fluid. In this case an outlet of the cutoff valve is hydraulically connected to an inlet of the metering valve. Such a construction of a metering unit, having a cutoff valve and a metering valve which are arranged in series, on the one hand allows a reliable cutoff of the fluid feed and on the other hand allows a precise metering of the desired injection quantity. The fact that the fluid feed can be cutoff by the cutoff valve independently of the metering valve means that an uncontrollable escape of fluid can reliably be prevented even in the event of a malfunction of the metering valve. This serves to increase the reliability of the injection system.

In one embodiment the inlets of the modules are hydraulically connected to a common fluid feed. In this case the common fluid feed is at least partially embodied as a pressure compensation volume. A fluid feed at least partially embodied as a pressure compensation volume ensures the necessary pressure isolation between the modules. A correspondingly large volume may be designed like a rail used in a common-rail system, for example, allowing recourse to the known experiences of common rail systems.

In an alternative embodiment the inlet of the second module is hydraulically connected via the pressure compensation volume to the outlet of the cutoff valve of the first module. In this embodiment the fluid feed of the entire injection system can be cut off by the cutoff valve of the first module. A cutoff valve in the additional modules can thereby be dispensed with, in order to reduce the costs of these modules.

In a variant of this embodiment the inlet of a third module is hydraulically connected to the pressure compensation volume, so that the pressure compensation volume is used in common for the second, third and any further modules and only one single pressure compensation volume is provided irrespective of the number of modules used. By using just one single pressure compensation volume it is possible to keep the costs of the injection system low.

In an alternative embodiment the inlet of the third module is hydraulically connected via a second pressure compensation volume to the outlet of the cutoff valve of the second module. Since in this embodiment each module is in each case coupled to a preceding module via its own pressure compensation volume, the individual pressure compensation volumes can be of smaller design than a common pressure compensation volume. By using multiple small pressure compensation volumes the injection system can be flexibly adapted to the space available and the installation of the injection system is simplified.

In one embodiment at least one metering device is provided for metering of the fluid. In this case the pressure compensation volume can be filled with fluid by the metering device. In a system in which the common pressure compensation volume can be filled with fluid by one metering device only one single metering device is required. This serves to further reduce the costs of the injection system.

In one embodiment a valve, in particular a non-return valve, is arranged between the pressure compensation volume and each module. Such a valve serves to isolate the individual modules hydraulically from one another. If the modules are hydraulically isolated from one another, the pressure compensation volume can be designed smaller and the operating reliability of the injection system is improved, since detrimental interactions between the individual modules are reliably prevented.

In a further embodiment a second metering device, which supplies a second pressure compensation volume with fluid, is hydraulically connected to the first metering device via a third pressure compensation volume. An injection system having such a construction can be extended as required; in particular the injection system can be constructed so that even large quantities of fluid can be injected into multiple exhaust tracts.

In one embodiment the injection units for injecting fluid are formed upstream of a catalytic converter arranged in the exhaust tract. This affords a catalytic combustion of the injected fluid and therefore an especially efficient regeneration of the filter arranged in the exhaust tract.

The invention will be explained in more detail below with reference to systems for injecting liquid fuel into an exhaust tract shown in the drawings attached. However, the invention can also be applied to systems for injecting other fluids, such as urea, for example.

DETAILED DESCRIPTION

Figure 1:
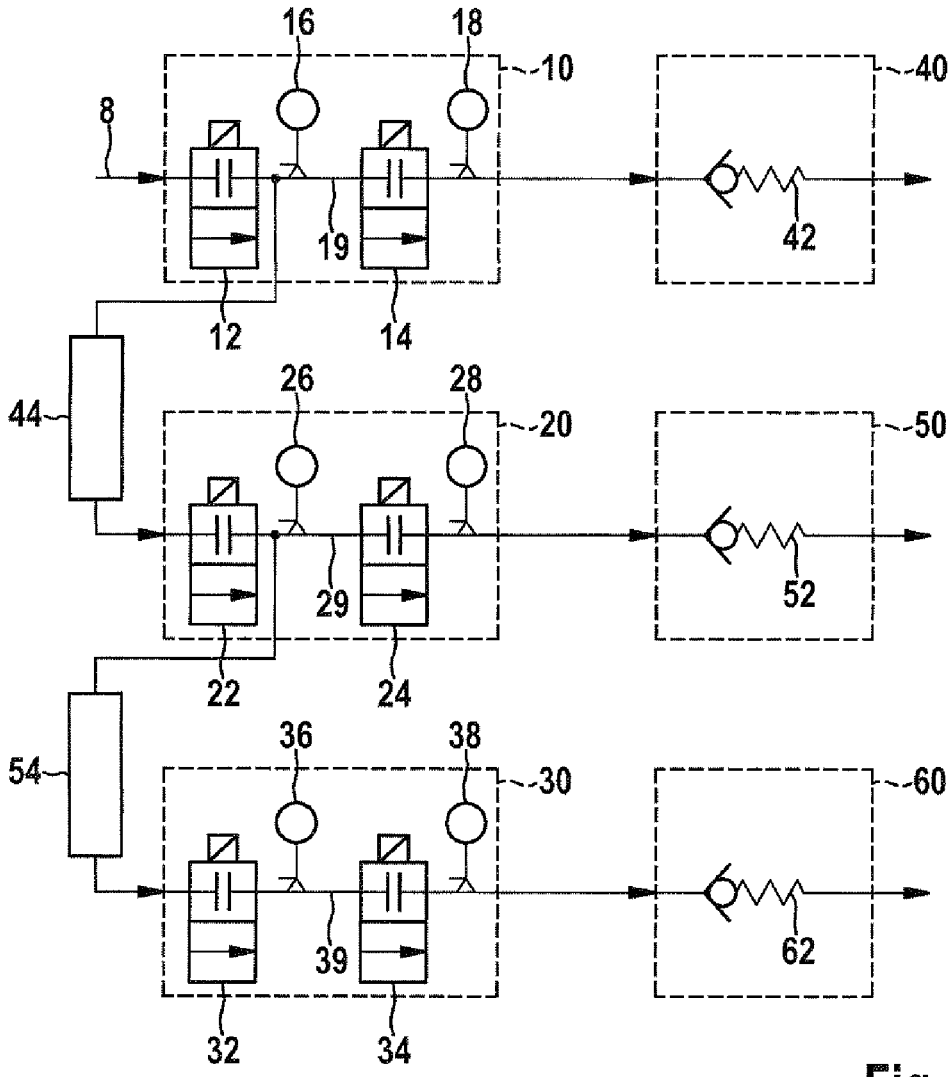
FIG. 1 shows a first exemplary embodiment of an injection system according to the invention having three metering units connected in series.

FIG. 1 shows a first exemplary embodiment of an injection system according to the invention having a first module, which comprises a first metering unit 10 and a first injection unit 40. The first metering unit 10 has a cutoff valve 12, serving to switch on and cut off a flow of fuel fed by a fuel feed 8. At the outlet, that is to say downstream of the cutoff valve 12 in the direction of flow, a pressure sensor 16 is arranged on a fuel line 19 in the first metering unit 10, in order to measure the pressure of the inflowing fuel. A metering valve 14, which is designed to meter the required injection quantity, is arranged downstream of the first pressure sensor 16 in the direction of flow. A second pressure sensor 18 is provided at the outlet of the metering valve 14, in order to measure the fuel pressure at the outlet of the metering valve 14. An outlet of the first metering unit 10 is hydraulically connected to an inlet of the first injection unit 40. Besides an injection valve 42, the injection unit 40 comprises a cooling adapter and a metal seal, which are not shown in the schematic representation in FIG. 1.

The injection valve 42 is arranged on an exhaust tract (also not shown) upstream of a catalytic converter, to inject in the fuel into the exhaust tract. The injected fuel undergoes catalytic combustion in the catalytic converter. The temperature around the exhaust tract thereby increases, so that deposits, which have settled in a particle filter arranged downstream of the catalytic converter, are burned and the filter is regenerated.

A first pressure compensation volume 44, which is filled with fuel from the fuel feed line 8 when the cutoff valve 12 is opened, is hydraulically connected to the fuel feed line 19 between the outlet of the cutoff valve 12 and the first pressure sensor 16 of the first metering unit 10. An outlet of the first pressure compensation volume 44 is connected to the inlet of a metering unit 20 of a second module, which comprises the second metering unit 20 and a second injection unit 50. When the cutoff valve 12 of the first metering unit 10 is opened, therefore, the metering unit 20 of the second module is supplied with fuel from the fuel feed 8 via the first pressure compensation volume 44.

The second metering unit 20 supplies the associated second injection unit 50 with a metered quantity of fuel. The second module comprising the second metering unit 20 and the second injection unit 50 is of identical construction to the first module comprising the first metering unit 10 and the first injection unit 40. Any repetition of a detailed description of the construction will therefore be dispensed with.

Between the cutoff valve 22 and the first pressure sensor 26 of the metering unit 20 of the second module a second pressure compensation volume 54, which supplies a metering unit 30 of a third module with fuel when the cutoff valve 22 is opened, is connected to a fuel line 29. The third module comprises a third injection unit 60, which is supplied with fuel by the metering unit 30 of the third module.

By connecting further metering units, not shown in FIG. 1, each having a further injection unit, to the fuel line 39 in the third metering unit 30 via additional pressure compensation volumes, not shown in FIG. 1, it is possible to extend the injection system shown in FIG. 1, as required.

Since modules of identical construction comprising the metering units 10, 20, 30 and the injection units 40, 50, 60, and pressure compensation volumes 44, 54 are used in each case, an injection system according to the invention is especially easy, flexible and cost-effective to produce. It is only necessary to produce three different elements, from which injection systems of any size can be assembled. Since a separate pressure compensation volume 44, 54 is used for the connection of each metering unit 10, 20, 30, the individual pressure compensation volumes 44, 54 can be small in size and can be easily and flexibly assembled.

Figure 2:
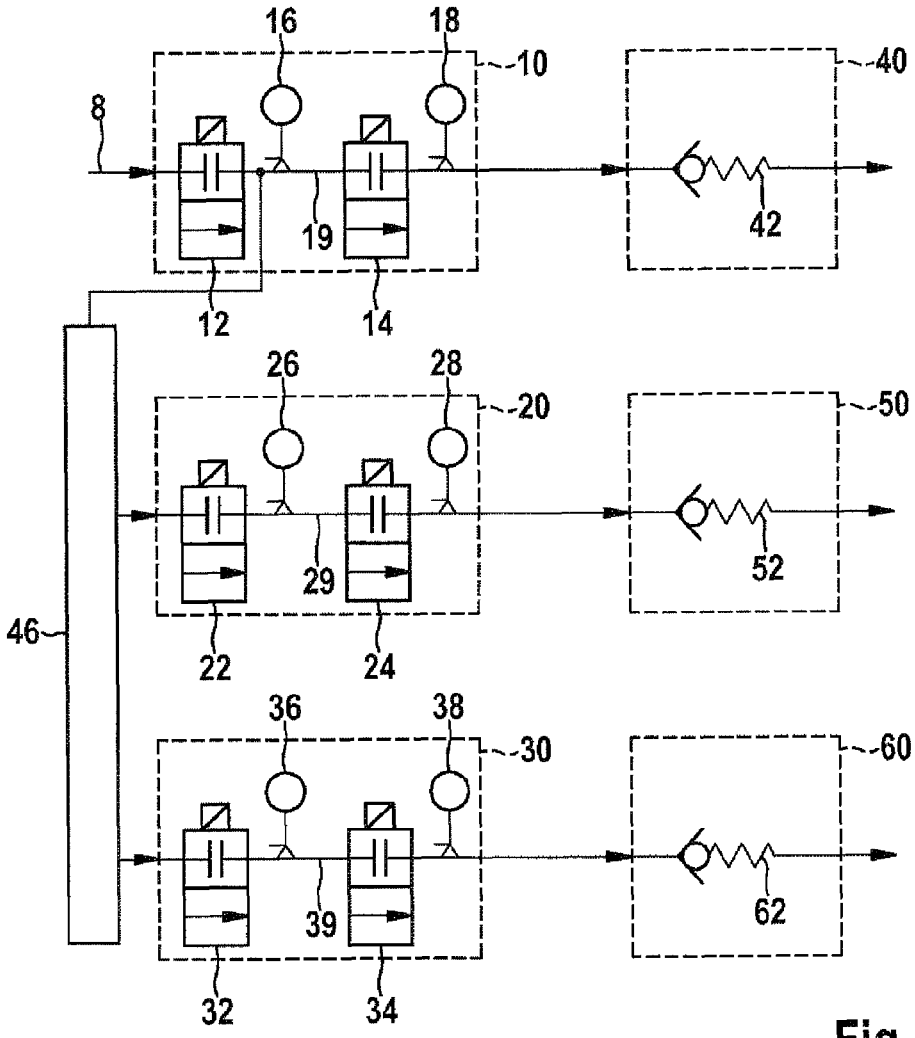
FIG. 2 shows a second exemplary embodiment of an injection system according to the invention, in which the metering units are connected to one another via a common pressure compensation volume.

FIG. 2 shows an alternative exemplary embodiment of an injection system according to the invention.

The metering units 10, 20, 30 and injection units 40, 50, 60 used in this exemplary embodiment are of identical construction to the units used in the first exemplary embodiment and for this reason will not be described again.

The exemplary embodiment shown in FIG. 2 differs from the exemplary embodiment shown in FIG. 1 in that both the second metering unit 20 and the third metering unit 30 and any further metering units not shown in FIG. 2 are connected to the pressure compensation volume 46, which downstream of the cutoff valve 12 is connected to the fuel line 19 of the first metering unit 10. Since only a single pressure compensation volume 46 is used in the exemplary embodiment shown in FIG. 2, it is possible to dispense with the production and assembly of multiple pressure compensation volumes. The injection system is therefore easy and cost-effective to manufacture and assemble.

Figure 3:
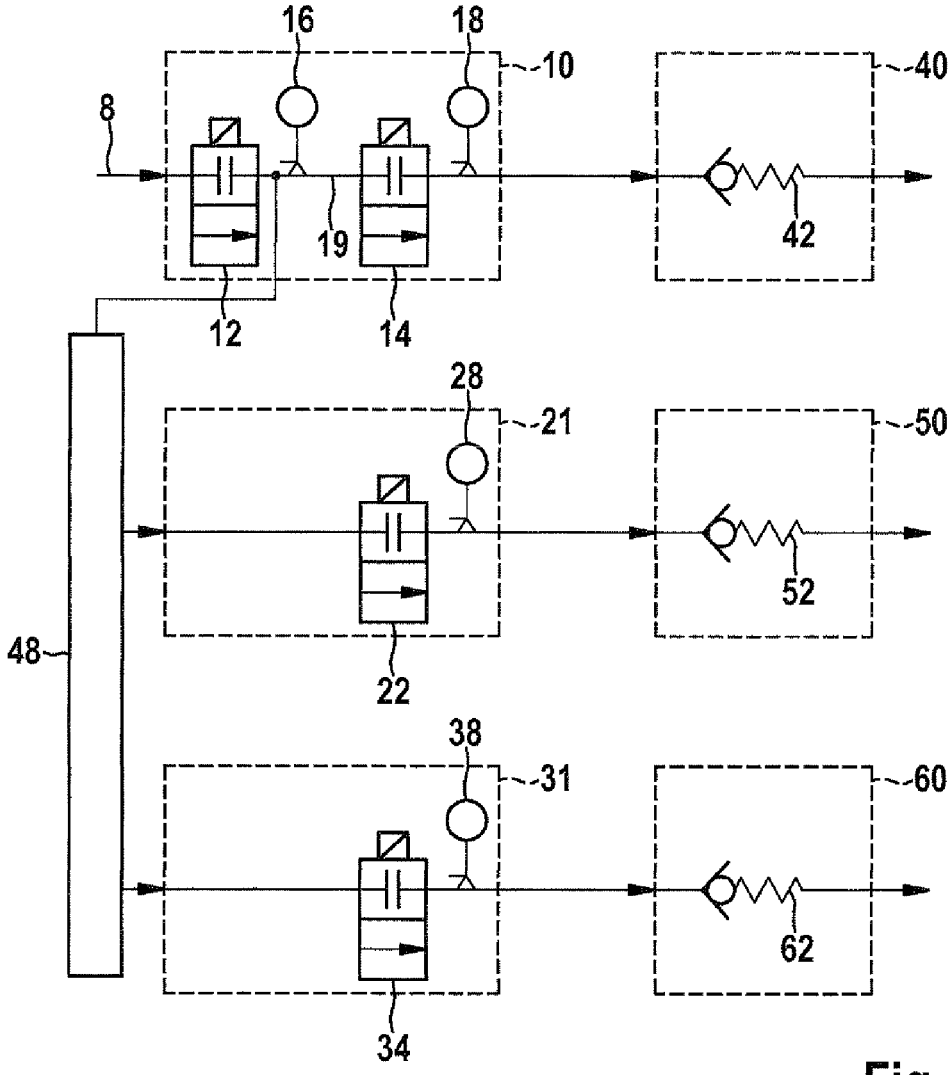
FIG. 3 shows a variant of the second exemplary embodiment having two simplified metering units.

FIG. 3 shows a variant of the exemplary embodiment shown in FIG. 2, the metering units 21, 31 connected to the pressure compensation volume 48 having no cutoff valve and each having only one pressure sensor 28, 38, which in each case is arranged downstream of the respective metering valve 22, 34.

Metering units 21, 31 which have no cutoff valve are referred to as "SLAVE" metering units 21, 31 and are more cost-effective to produce than a so-called "MASTER" metering unit 10, which additionally comprises a cutoff valve 12 and a first pressure sensor 16 between the cutoff valve 12 and the metering valve 14. In this exemplary embodiment the fuel feed for the entire injection system can be cut off by closing of the cutoff valve 12 in the first "MASTER" metering unit 10.

Figure 4:
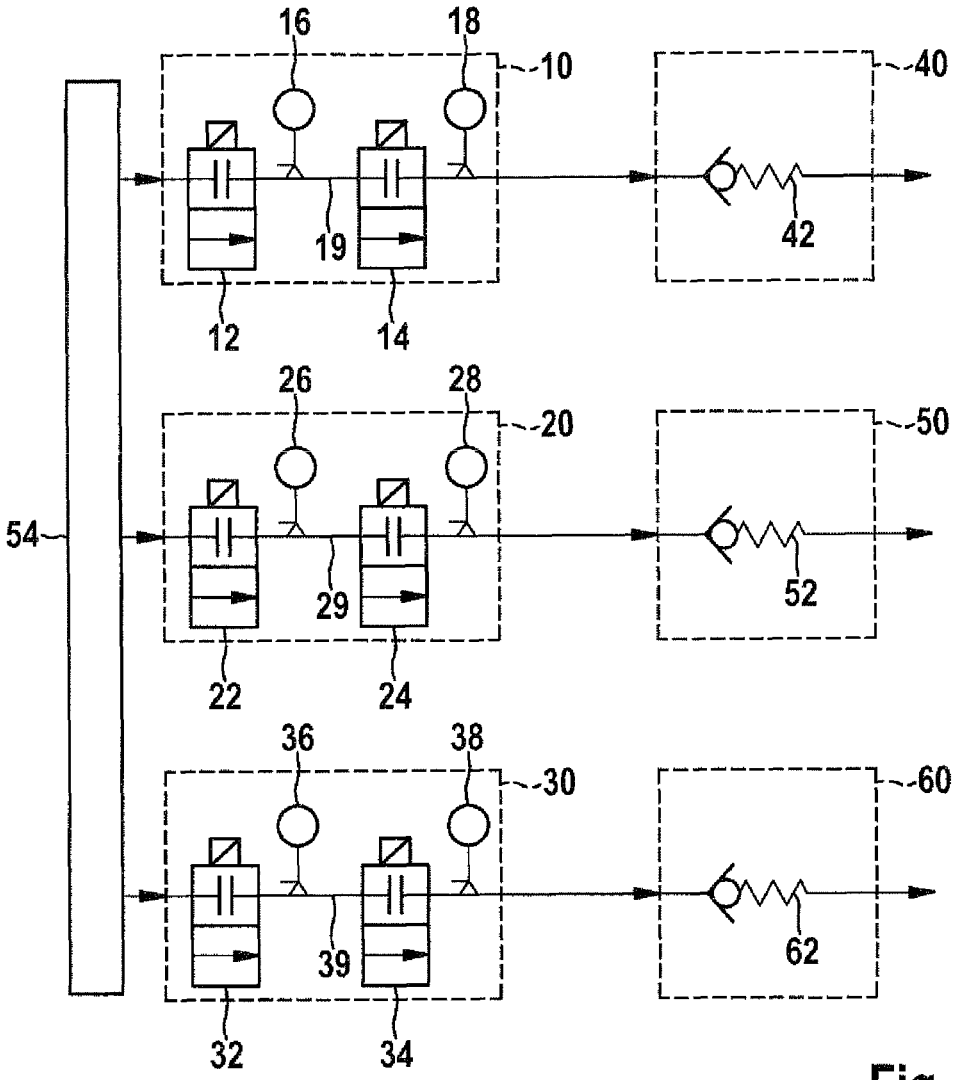
FIG. 4 shows a third exemplary embodiment, in which all three metering units are supplied with fluid via a common pressure compensation volume.

FIG. 4 shows a third exemplary embodiment having three "MASTER" metering units 10, 20, 30, which are of identical construction to the metering units of the first exemplary embodiment and are connected to a common fuel feed 54. In this case the common fuel feed 54 ("common rail") is at least partially embodied as a pressure compensation volume. It is possible in this exemplary embodiment to resort to components used in and experience gained with common rail systems, making this exemplary embodiment particularly easy and cost-effective to produce.

In an alternative exemplary embodiment (not shown) the metering units are embodied as "SLAVE" metering units without cutoff valve, and one central cutoff valve is formed in the feed line (not shown) for the common fuel feed 54.

Figure 5:
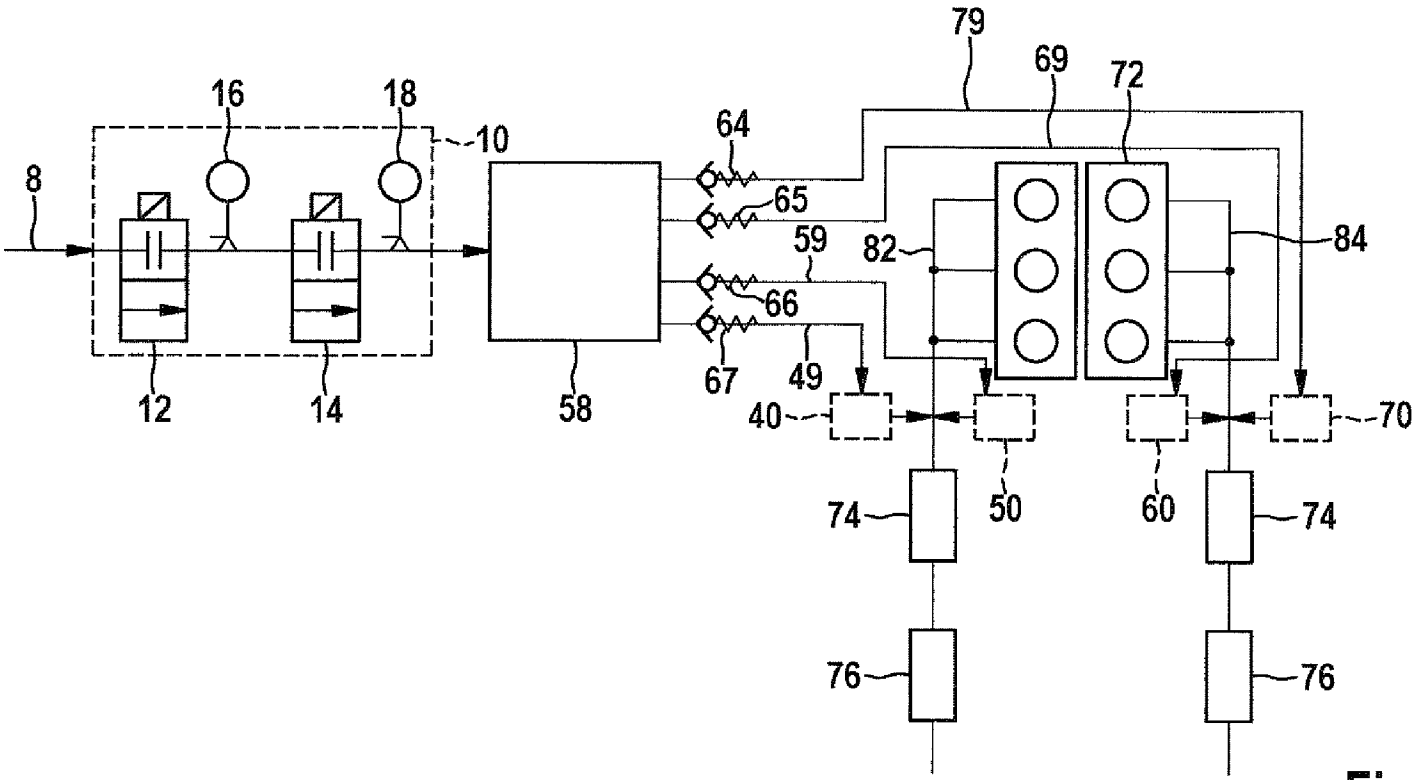
FIG. 5 schematically shows an internal combustion engine having an exhaust system and a fourth exemplary embodiment of an injection system according to the invention, in which a common pressure compensation volume is fed by a single metering unit.

FIG. 5 shows an alternative exemplary embodiment of an injection system according to the invention, in which the individual modules each comprise an injection unit 40, 50, 60, 70 and are supplied with fuel from a common metering unit 10 via a common pressure compensation volume 58.

FIG. 5 schematically shows an internal combustion engine 72 having six cylinders and two exhaust tracts 82, 84. A particle filter 76, which is designed to filter particles out of the exhaust gas flow, is arranged in each of the exhaust tracts 82, 84. An oxidation catalytic converter 74 is arranged in each of the exhaust tracts 82, 84 between the internal combustion engine 72 and the respective particle filter 76.

Altogether four injection units 40, 50, 60, 70 are arranged on the exhaust tracts 82, 84, in order to inject the fuel metered by the metering unit 10 into the respective exhaust tract 82, 84 upstream of the oxidation catalytic converters 74. The injected fuel undergoes catalytic combustion in the oxidation catalytic converters 74. Due to the combustion the temperature in the exhaust tracts 82, 84 is increased to such an extent that soot, which has settled in the particle filters 76, is burned and the particle filters 76 are regenerated.

The exemplary embodiment of an injection system according to the invention shown in FIG. 5 comprises a metering unit 10, which is known from the first exemplary embodiment and which is supplied with fuel via a fuel feed 8. The metering unit 10 feeds a quantity of fuel metered by the metering unit 14 into a common pressure compensation volume 58, which is hydraulically connected to four injection units 40, 50, 60, 70. The four injection units 40, 50, 60, 70 can thus be supplied with fuel from the pressure compensation volume 58. The injection units 40, 50, 60, 70 are of identical construction to the injection units 40, 50, 60 described in connection with the preceding exemplary embodiments and will therefore not be described again.

Each of the four injection units 40, 50, 60, 70 is connected via its own fuel line 49, 59, 69, 79 to the pressure compensation volume 58. In each of the fuel lines 49, 59, 69, 79 a non-return valve 64, 65, 66, 67 is provided between the pressure compensation volume 58 and the respective injection unit 40, 50, 60, 70. The non-return valve 64, 65, 66, 67 prevents fuel flowing back out of the injection units 40, 50, 60, 70 into the pressure compensation volume 58. The injection units 40, 50, 60, 70 are thus hydraulically isolated from one another.

The exemplary embodiment of an injection system shown in FIG. 5 comprises only a single metering unit 10 and a single pressure compensation volume 58. It is therefore especially cost-effective to produce and takes up only a small amount of space.

Figure 6:
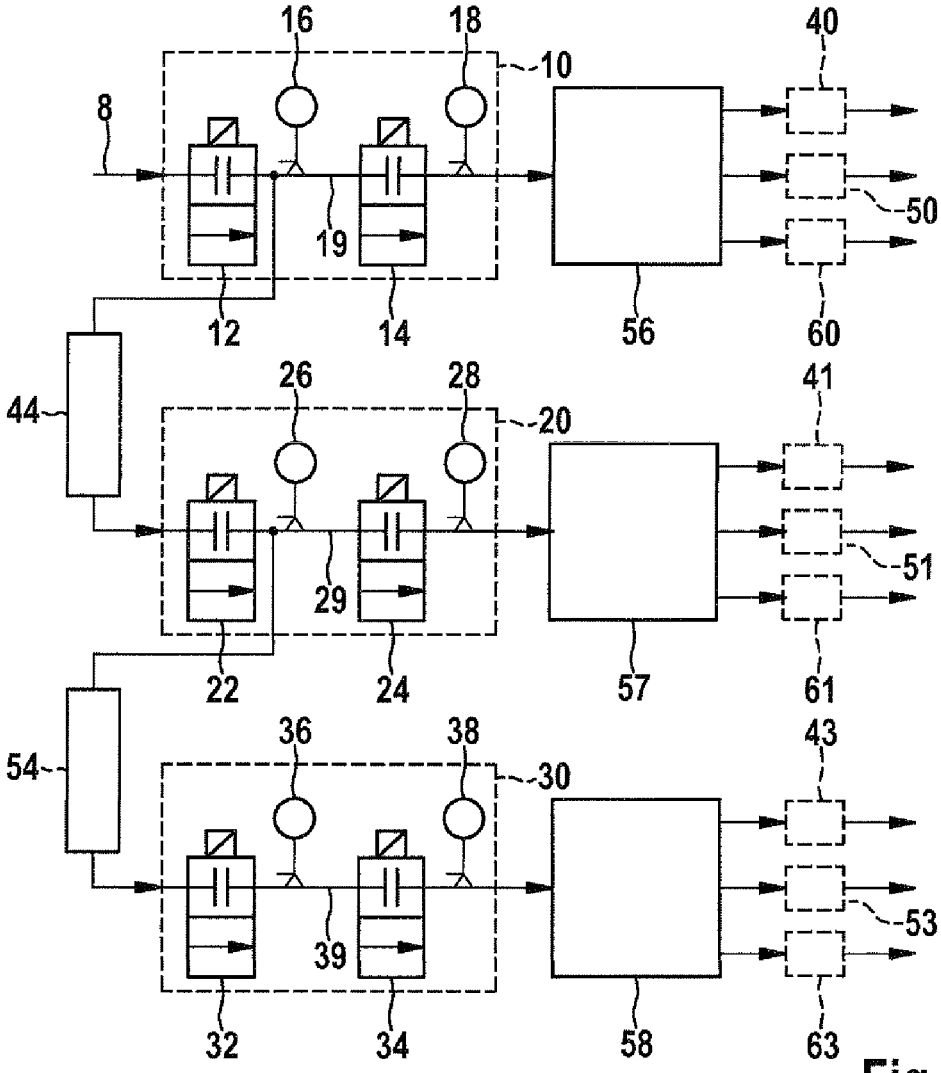
FIG. 6 shows a combination of the exemplary embodiments shown in FIGS. 1 and 5.

FIG. 6 shows a further exemplary embodiment of an injection system according to the invention, in which the first exemplary embodiment is combined with the fourth exemplary embodiment.

The exemplary embodiment shown in FIG. 6 comprises three metering units 10, 20, 30, each intended for filling a pressure compensation volume 56, 57, 58 assigned to the respective metering unit 10, 20, 30 with a metered quantity of fuel. Connected to each of the pressure compensation volumes 56, 57, 58 are three injection units 40, 50, 60, 41, 51, 61, 43, 53, 63, which are of identical construction to the injection units 40, 50, 60 described in connection with the exemplary embodiments previously described and which, in particular, each have an injection nozzle (not shown in FIG. 7) for injecting the fuel metered by the metering unit 10, 20, 30 into an exhaust tract (not shown).

The first metering unit 10 is supplied with fuel by a fuel feed 8.

As in the first exemplary embodiment, the second metering unit 20 is connected to the first metering unit 10 via a pressure compensation volume 44, which downstream of the cutoff valve 12 is connected to the fuel line 19 of the first metering unit 10, and is supplied with fuel via this pressure compensation volume 44.

The second metering unit 30 is connected to the first metering unit 20 via a second pressure compensation volume 54, which downstream of the cutoff valve 12 is connected to the fuel line 12 of the second metering unit 20, and is supplied with fuel via the second pressure compensation volume 54.

The exemplary embodiment shown in FIG. 6 combines the advantages of the first exemplary embodiment (FIG. 1) with the advantages of the fourth exemplary embodiment (FIG. 6). In particular the two-stage modular construction of this exemplary embodiment allows a particularly flexible adaptation of the injection system to any exhaust system and in particular allows large quantities of fuel to be injected into especially large exhaust systems comprising a plurality of exhaust tracts.

The construction shown in FIG. 6, having three metering units 10, 20, 30, each supplying three injection units 40, 50, 60, 41, 51, 61, 43, 53, 63 with fuel, is only an example. Each of the metering units 10, 20, 30 can supply any greater or lesser number of injection units 40, 50, 60, 41, 51, 61, 43, 53, 63 with fuel. In the same way it is possible to combine any number of metering units 10, 20, 30, in order to provide an injection system of the required size.

In alternative exemplary embodiments not shown in the figures the additional metering units 20, 30 are connected to the first metering unit 10 via a common pressure compensation volume according to the second exemplary embodiment. The additional metering units 20, 30 may also be designed as "SLAVE" metering units 21, 31 with no shutoff valve 22, 32 of their own, in order to keep the costs of the injection system low.

Alternatively all three metering units 10, 20, 30 may be connected via a common fuel feed, which is at least partially embodied as a pressure compensation volume according to the third exemplary embodiment.

What is claimed is:

1. An injection system for injecting a fluid into an exhaust tract, the injection system comprising at least two modules and at least one pressure compensation volume (44, 46, 48, 54, 56, 58); each module comprises at least one injection unit (40, 50, 60) operable to inject the fluid into the exhaust tract, and the pressure compensation volume (44, 46, 48, 54, 56, 58) is operable to feed the fluid to at least one of the modules and connects at least two of the modules hydraulically to one another, wherein at least the first module comprises a metering unit (10, 20, 30; 21, 31) for metering the fluid, wherein the metering unit (10, 20, 30) comprises a cutoff valve (12, 22, 32) for cutting off the fluid feed and a metering valve (14, 24, 34) for metering the fluid, and wherein an outlet of the cutoff valve (12, 22, 32) is hydraulically connected to an inlet of the metering valve (14, 24, 34), and wherein an inlet of the second module is hydraulically connected via the pressure compensation volume (44, 46) to an outlet of a cutoff valve (12) of the first module.

2. The injection system as claimed in claim 1, wherein inlets of the modules are hydraulically connected to a common fluid feed (54), and wherein the common fluid feed (54) is at least partially embodied as a pressure compensation volume.

3. The injection system as claimed in claim 1, having a third module, wherein an inlet of the third module is hydraulically connected to the pressure compensation volume (46).

4. The injection system as claimed in claim 1, having a third module and a second pressure compensation volume (54), wherein an inlet of the third module is hydraulically connected via the second pressure compensation volume (54) to an outlet of a cutoff valve (22) of the second module.

5. An injection system for injecting a fluid into an exhaust tract, the injection system comprising at least two modules and at least a first and a second pressure compensation volume (44, 56); each module comprises at least one injection unit (40, 50, 60, 41, 51, 61) operable to inject the fluid into the exhaust tract, and the first pressure compensation volume (44) is operable to feed the fluid to at least one of the modules and connects at least two of the modules hydraulically to one another;

wherein the injection system further includes at least one metering device (10) for metering of the fluid, wherein the second pressure compensation volume (56) can be filled with fluid by the metering device (10).

6. The injection system as claimed in claim 5, wherein the metering device (10) comprises a cutoff valve (12) for cutting off the fluid feed and a metering valve (14) for metering the fluid.

7. The injection system as claimed in claim 5, wherein a valve (64, 66, 68) is arranged between the second pressure compensation volume (56) and each injection unit (40, 50, 60).

8. The injection system as claimed in claim 5, wherein the at least one metering device (10) includes a first metering device (10), and the injection system further having a second metering device (20), wherein the second metering device (20) is hydraulically connected to the first metering device (10) via the first pressure compensation volume (44).

9. The injection system as claimed in claim 1, wherein the injection units are operable so that the fluid can be injected into the exhaust tract upstream of a catalytic converter arranged in the exhaust tract.

10. The injection system as claimed in claim 7, wherein the valve (64, 66, 68) is a non-return valve.

* * * * *